US005832984A

United States Patent [19]

Pleschiutschnigg et al.

[11] Patent Number: 5,832,984

[45] Date of Patent: Nov. 10, 1998

[54] METHOD OF PRODUCING LONG STEEL PRODUCTS

[75] Inventors: Fritz-Peter Pleschiutschnigg, Duisburg; Lothar Parschat, Ratingen; Dieter Stalleicken, Duisburg; Winfried Binder, Kevelaer; Klaus Brückner, Haan; Ingo von Hagen, Krefeld; Werner Rahmfeld, Mülheim, all of Germany

[73] Assignee: Mannesmann Aktiegesellschaft, Dusseldorf, Germany

[21] Appl. No.: 711,349

[22] Filed: Sep. 5, 1996

Related U.S. Application Data

[63] Continuation of Ser. No. 979,542, Nov. 23, 1992, abandoned.

[30] Foreign Application Priority Data

Nov. 26, 1991 [DE] Germany ..... 41 39 242.6

[51] Int. Cl.[6] ..... B21B 1/46; B22D 11/12

[52] U.S. Cl. ..... 164/476; 164/417; 164/424

[58] Field of Search ..... 164/476, 417, 164/424

[56] References Cited

U.S. PATENT DOCUMENTS

| | | | |
|---|---|---|---|
| 3,393,727 | 7/1968 | Rys | 164/424 |
| 3,693,701 | 9/1972 | Waclawiczek | 164/417 |
| 4,683,938 | 8/1987 | Bower et al. | 164/417 X |
| 4,815,520 | 3/1989 | Wuetig | 164/476 |

FOREIGN PATENT DOCUMENTS

| | | | |
|---|---|---|---|
| 51-37031 | 3/1976 | Japan | 164/417 |
| 63-215353 | 9/1988 | Japan | 164/476 |
| 1-162551 | 6/1989 | Japan | 164/476 |
| 3-198964 | 8/1991 | Japan | 164/476 |

*Primary Examiner*—J. Reed Batten, Jr.

*Attorney, Agent, or Firm*—Cohen, Pontani, Lieberman & Pavane

[57] ABSTRACT

Molten steel is poured into a water cooled continuous casting mold in which the steel solidifies partially with the formation of a strand having a length and a peripheral shell. The strand has a cross-sectional surface area with one of a round shape, an oval shape and a polygonal shape having more than four sides. Additionally, the strand has a minimum circumference of 200 mm. The cross-sectional surface area of the strand leaving the mold is then reduced using rolls before the strand fully solidifies. The reducing includes deforming the strand into a polygonal shape having at least four corners while maintaining the circumference as well as the length of the strand at the peripheral shell constant.

6 Claims, 1 Drawing Sheet

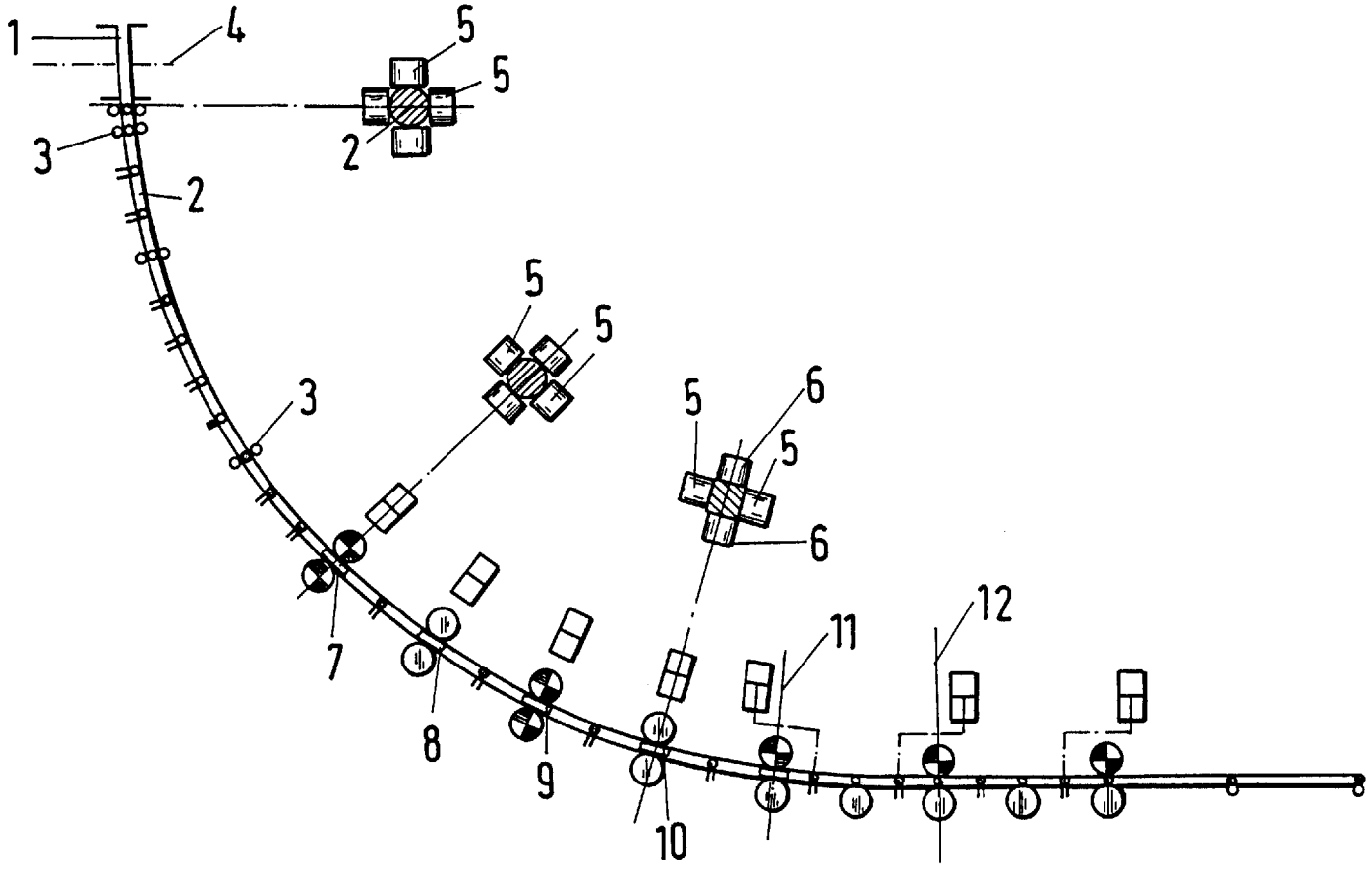
1
2
3
4
5
6
7
8
9
10
11
12

METHOD OF PRODUCING LONG STEEL PRODUCTS

This is continuation of application Ser. No. 07/979,542, filed Nov. 23,1992 and now abandoned.

BACKGROUND OF THE INVENTION

1. Field of the Invention

The present invention relates to a method of producing long products of steel by continuous casting in a continuous casting mold, wherein the steel products are dimensioned for the initial pass of a rolling mill for long products.

2. Description of the Related Art

It is known from DE 36 06 507 C2 to produce in a continuous casting plant long products having a round cast cross-section and to deform the strand in a deforming stage following the continuous casting plant to a round shape which corresponds in its dimensions to the initial pass section of a rolling mill for long products, such as section rods, section girders, wire or rails. The deformation of the cast strand takes place exclusively in the fully solidified portion of the strand.

It is known from DE OS 15 83 620 to produce in a continuous casting mold strands having a square cross-section and to carry out a deformation in a portion in which the strand is not yet fully solidified in constant successive steps of small size, wherein the cross-section of the strand is reduced, however, the cross-sectional shape of the cast strand is essentially maintained.

This method did make possible improvements compared to the continuous casting procedure for billet sizes of square and rectangular shape as far as the strand quality and the steel quality to be cast are concerned, and compared to the ingot casting as far as costs are concerned.

However, the known method still has the disadvantage that interior segregations occur in the strand. It has been attempted in the past to counteract these segregations and the resulting reduction of quality of the final product by "cold" casting, i.e., with superheating of the melt in the tundish of only 10° to 15° K above liquidus temperature and/or by electromagnetically stirring the melt.

However, the quality which can be obtained does not meet the requirements made of a number of products, such as, needles or balls for the manufacture of bearings.

SUMMARY OF THE INVENTION

Therefore, it is the primary object of the present invention to provide a method of the above-described type in which the above-mentioned disadvantages are eliminated and in which the strand produced by continuous casting of steel is influenced during its solidification in such a way that interior segregation is suppressed or practically eliminated.

In accordance with the present invention, liquid steel is poured into a water-cooled continuous casting mold in which the steel solidifies partially with the formation of a ring-shaped strand shell, as seen in cross-section of the strand, having a round or oval shape of the cross-sectional area of the strand or a polygonal shape having more than four corners and having a minimum circumference of 200 millimeters. The strand produced in this manner in the mold is reduced underneath the mold in its cross-sectional surface area until the strand fully solidifies by means of support members such as rolls which act in a deforming manner on the strand, such that, while essentially maintaining its circumferential length, the strand is deformed into a shape meeting these requirements having a polygonal cross-section with at least four corners and of a symmetry that is lower than that of the strand leaving the mold.

In accordance with a further development of the invention, the deformation of the strand is carried out at the 2-phase region below a lowest point of superheating the strand. In the two-phase region there is present a mixture of crystals in liquid steel surrounded by a solidified shell.

Another feature provides that the strand is reduced in its cross-sectional area by at least 5% to up to 50% in at least one deformation stage.

In accordance with a particularly preferred embodiment, the total deformation is carried out in three deformation stages.

Another feature of the invention provides that the strand is deformed by applying tensile forces between the individual deformation stages in order to reduce the circumference of the strand.

In accordance with another feature, the deformation of the strand is carried out by support members whose surfaces located opposite each other in the cross-sectional plane of the respective deformation stage provide the strand with a cross-sectional shape which is as closely as possible the shape and the size of that of the final product to be produced, i.e., the casting procedure produces a product having dimensions which are close to that of the final product.

Finally, in oval curved plants, straightening deformation is carried out after a deformation for reducing the diameter of the strand.

In addition to eliminating interior segregations in the strand, the method steps according to the present invention lead to a refined crystal structure and the degree of casting to final dimensions is improved. This is because the casting cross-section can now be changed from bloom dimensions to billet dimensions. The invention makes available another in-line production line for long products.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWING

In the Drawing:

The single FIGURE of the drawing is a schematic illustration of a plant for producing long products of steel in accordance with the method of the invention.

DESCRIPTION OF THE PREFERRED EMBODIMENT

The product to be manufactured by the continuous casting plant is a billet having a square cross-section with a side length of 100 millimeters. For this purpose, a round strand 2 having a diameter of 127.4 millimeters is cast in a continuous casting mold 1 of conventional construction. The diameter of 127.4 millimeters corresponds to a strand circumference of 400 millimeters and a cross-sectional size of 12,741 $mm^2$. The strand is guided in a curve underneath the mold by rolls 3. The radius 4 of the curve, as well as the radius of the curved mold 1 is approximately 7,000 millimeters. A strand withdrawal speed of 5 m/min results in a metallurgical length of about 15,000 millimeters. Along this length, the strand 2 is deformed from a round cross-sectional shape into a rectangular cross-sectional shape by means of two pairs of rolls 5, 6 which have smooth cylinders and are arranged in pairs opposite each other in a plane. Depending on the steel quality, the deformation can take place in one or several stages. In steel qualities which easily form cracks, preferably up to four deformation stages 7, 8, 9 and 10 are used. The extent of the deformation in the individual stages is to be selected in such a way that the internal deformation at the liquid/solid interface is not above the yield strength of the material. When taking this condition into consideration, the extent of deformation may also be the same in all stages. In the deformation stages 7 to 10, the diameter of the round strand is reduced from 127 millimeters by 6.8 millimeters each, so that in the deformation stage 10 a square billet is obtained which has a side length of 100 millimeters with the same circumference as the round strand, but with a cross-sectional area which is reduced as compared to the round strand.

The deformation is carried out at the 2-phase region below the lowest point of melt superheating, so that for the finished product a substantial portion of the structure with small grain size corresponding to a rolled structure is already present in the cast strand. Accordingly, the deformation is carried out within a portion of the strand in which more than 20% of the strand cross-section and up to 70% of the strand cross-section are still liquid. In steel qualities which easily form cracks, it must be ensured that additional deformations, such as straightening stages in oval curved plants, are not superimposed on the deformations for reducing the cross-sectional area.

In the illustrated embodiment, two straightening stages are denoted by reference numerals 11 and 12 and are located within the strand portion having a liquid content. However, it is within the scope of the invention to arrange the deformation stages 7, 8, 9, 10 and the straightening stages 11, 12 in such a way that one of the straightening stages is always located between two successive deformation stages.

It should be understood that the preferred embodiments and examples described are for illustrative purposes only and are not to be construed as limiting the scope of the present invention which is properly delineated only in the appended claims.

What is claimed is:

1. A method of producing by continuous casting in a continuous casting mold long steel products of a desired dimension, the method comprising pouring liquid steel into a water-cooled continuous casting mold in which the steel solidifies partially with the formation of a strand having a length and a peripheral shell, wherein the strand has a cross-sectional surface area with one of a round shape, an oval shape and a polygonal shape having more than four corners, and wherein the strand has a minimum circumference of 200 millimeters, and reducing the cross-sectional surface area of the strand leaving the mold using rolls before the strand fully solidifies, the reducing including deforming the strand into a polygonal shape having at least four corners while maintaining the circumference as well as the length of the strand constant.

2. The method according to claim 1, comprising carrying out the deforming in a two-phase region in which the core is a mixture of crystals and liquid.

3. The method according to claim 1, wherein the strand is reduced in its cross-sectional surface area by at least 5% to 50% in at least one deformation stage.

4. The method according to claim 3, wherein the deforming is carried out in three deformation stages.

5. The method according to claim 1, comprising deforming the strand by rolls whose surfaces located opposite each other in the cross-sectional plane of the respective deformation stage provide the strand with a cross-sectional shape which is substantially the same as the shape of the final product to be produced.

6. The method according to claim 1, comprising utilizing an oval curved mold, and carrying out a straightening deformation following a deformation for reducing the strand.

* * * * *